United States Patent [19]

Colglazier et al.

[11] 4,165,069

[45] Aug. 21, 1979

[54] COPIER HAVING REMOVABLE PAPER FEED MODULE

[75] Inventors: Donald F. Colglazier; Ernest P. Kollar, both of Longmont; Fred R. Mares, Boulder, all of Colo.

[73] Assignee: International Business Machines Corporation, Armonk, N.Y.

[21] Appl. No.: 820,988

[22] Filed: Aug. 1, 1977

[51] Int. Cl.[2] ..... B65H 1/00

[52] U.S. Cl. ..... 271/162

[58] Field of Search ..... 271/10, 18, 162, 163, 271/164, 256

[56] References Cited

U.S. PATENT DOCUMENTS

| | | | |
|---|---|---|---|
| 3,776,545 | 12/1973 | White | 271/163 X |
| 3,806,112 | 4/1974 | Melby | 271/10 |
| 3,883,242 | 5/1975 | Takehashi | 355/3 R |
| 3,976,371 | 8/1976 | Moser | 355/3 DD |
| 3,985,436 | 10/1976 | Tanaka | 355/8 |
| 3,997,262 | 12/1976 | Doi | 355/11 |

FOREIGN PATENT DOCUMENTS

| | | | |
|---|---|---|---|
| 1966526 | 1/1973 | Fed. Rep. of Germany | 271/162 |
| 1430810 | 4/1976 | United Kingdom | 271/162 |

*Primary Examiner*—Richard A. Schacher
*Attorney, Agent, or Firm*—Francis A. Sirr

[57] ABSTRACT

An electrophotographic copier having a cut sheet, two-bin, paper feed module which is selectively secured in copier-operative position, whereat it is operable to feed sheets to the copier's paper aligner and transfer station, or is removable to a copier-inoperative position whereat the module remains operative to feed sheets for the purpose of examination, analysis, and/or repair and maintenance of the paper feed module.

9 Claims, 3 Drawing Figures

COPIER HAVING REMOVABLE PAPER FEED MODULE

BACKGROUND AND SUMMARY OF THE INVENTION

In a cut sheet copier, one of the more complex copier process components is the paper feed mechanism. It has been the prior art practice to construct this mechanism as an integral, non-removable part of the copier, such that repair or replacement of the paper feed mechanism required partial disassembly of the copier. The present invention simplifies this procedure by a construction and arrangement which includes a paper feed module operable to feed paper in either of two physical positions, one within the copier, and the other removed from the copier. In said other position, the paper feed module can be operated as if it were in the copier, and malfunctions can be analyzed, or perhaps the mechanism can be periodically maintained and adjusted in the sense of preventive maintenance. This construction and arrangement is such that the paper feed module is accurately physically located in the copier when in said one position so as to insure a reliable copy process.

It is recognized that prior copiers have been constructed and arranged with a drawer-like unit which is mechanically and electrically detachably connected to the remaining portions of the copier. Copiers have also been constructed with removable body portions such that the various copier components are accessible for service and the like. For example, one in which the copier's photoreceptor, developer and cleaner are integrally incorporated as one releasable unit to facilitate maintenance of these components.

In addition, copiers have been constructed having upper and lower frame members, the upper frame member being pivotally connected to the lower frame member for access to the internal mechanisms, to thereby facilitate maintenance and replacement of the copier components.

Sheet feeding apparatus are known which may be attached to a further processing machine to cooperate therewith.

The prior art fails to teach the concept of a copier having a removable paper feed module which is movable from a copier-operative position to a copier-inoperative position, wherein the module is operative in its copier-inoperative position, to thus facilitate operation, analysis, adjustment or repair thereof.

The foregoing and other features and advantages of the invention will be apparent from the following more particular description of a preferred embodiment of the invention, as illustrated in the accompanying drawing.

Incorporation by Reference

The copier apparatus generally described herein is of the IBM Series III Copier/Duplicator type, and its Service Manual Form Number 241-5928-0, March 1976, is incorporated herein by reference.

The IBM TECHNICAL DISCLOSURE BULLETIN of February 1974, at pages 2966 and 2967, discloses an alternate means of feeding paper by way of friction feed rollers.

Cross-Reference to Related Application

Copending application, Ser. Number 788,471, filed Apr. 18, 1977, and commonly assigned, describes and claims the construction and arrangement of a combing wheel sheet feeder of the type which preferably is used to feed cut-sheet paper from the two paper supply bins of FIG. 1, and this application is incorporated herein by reference.

DESCRIPTION OF THE PREFERRED EMBODIMENT

Figure 1:
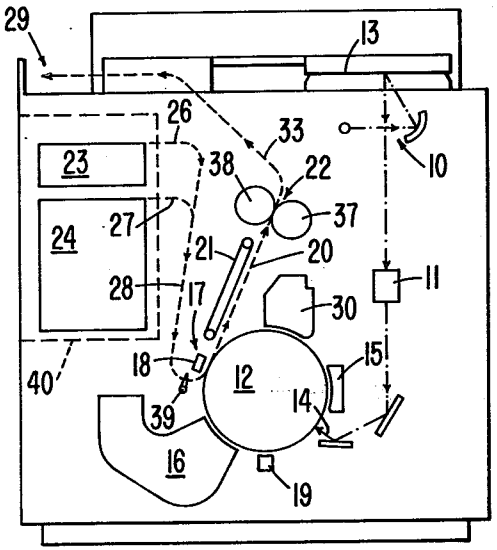
FIG. 1 is a schematic front view of an electrophotographic copier incorporating the present invention.

FIG. 1 is a schematic view of a xerographic copier incorporating the present invention. In this device a scanning mirror system 10 and a moving lens 11 move in synchronism with the rotation of photoconductor drum 12 to place a latent image of stationary original document 13 onto the drum's surface. Drum 12 is constructed and arranged with two photoconductor panels on its circumference, so as to be capable of producing two copies for each drum revolution.

As is well known, prior to imaging at 14, the drum is charged by corona 15. Since only the photoconductor's working area, i.e. the area which will correspond to a sheet of copy paper at transfer station 17, need be charged, the photoconductor surrounding this working area is erased by erase station 19, for example by means described in the IBM TECHNICAL DISCLOSURE BULLETIN of November 1976, at pages 1983 and 1984.

After imaging, the drum's latent image is developed by magnetic brush developer 16. Thereafter the drum's toned visible image is transferred to a sheet of plain copy paper at transfer station 17 by operation of transfer corona 18. A Bernoulli sheet detach means, as shown in the IBM TECHNICAL DISCLOSURE BULLETIN of January 1973 and May 1973, at pages 2378 and 365, respectively, operates to cause the now-toned sheet to leave the surface of the drum and to follow sheet movement path 20, adjacent vacuum conveyor 21, on its way to hot roll fuser assembly 22. As the sheet moves through path 20, the sheet's straight leading edge is perpendicular to path 20. After fusing, the finished copy sheet follows sheet path 33 and is deposited in output tray 29.

After transfer, the drum is cleaned as it passes cleaning station 30.

The copier of FIG. 1 includes two copy sheet supply bins 23 and 24. Each supply bin includes a bidirectional, vertically movable elevator which supports the stack. While this structure is well known to those of skill in the art, an exemplary structure is described in the IBM TECHNICAL DISCLOSURE BULLETIN of August 1974, at pages 670 and 671. Feed means of the type referred to above, within the bin selected for use, is operable to feed the stack's boundary sheet, i.e. the top sheet, to its sheet discharge path 26, 27. This sheet is rear-edge-aligned as it travels down aligner sheet path 28 to be momentarily stopped at paper registration gate 39. Such an aligner is described in the IBM TECHNICAL DISCLOSURE BULLETIN of September 1972, at page 1253.

As the leading edge of the drum's toned image arrives in the vicinity of this gate, the gate is opened to allow the sheet to move into transfer station 17 with its leading edge in exact registry with the drum's image leading edge.

The construction of hot roll fuser assembly 22 will not be described in detail. Generally, hot roll 37 is heated to an accurately controlled temperature by an internal heater and an associated temperature control system, not shown. The hot roll preferably includes a deformable external surface formed as an elastomeric surface. This surface is designed to engage the toned side of the copy sheet, fuse the toner thereon, and readily release the sheet with a minimum adherence of residual toner to the hot roll. Such a hot roll is described, for example, in the IBM TECHNICAL DISCLOSURE BULLETIN of August 1973, at page 896.

Backup roll 38 is preferably a relatively cool and rigid roll. Rolls 37 and 38 are circular cylinders, such that the fusing nip formed thereby defines a line (of some width due to deformation of hot roll 37) parallel to the axis of rolls 37 and 38.

The fusing nip formed by rolls 37 and 38 may be closed and opened in synchronism with the arrival and departure of the copy sheet's leading and trailing edges, respectively. This synchronism is achieved by a drum position sensing means, not shown, which responds to the position of drum 12 and effects opening and closing of the nip by means of a copier logic control system, not shown. An exemplary mechanism for effecting the opening and closing of this nip is shown in the IBM TECHNICAL DISCLOSURE BULLETIN of May 1973, at page 3644. In the alternative, for a multicopy run, the fusing nip may remain continuously closed until the trailing end of the last sheet has passed therethrough.

The term copier logic control system is intended to encompass the various means known to those of skill in the art. Generally known forms involve electronic processors, hard-wired logic circuits, electromechanical relays, and/or cam controlled switches or their equivalent. As is well known, the drum's changing position generates position signals which are then related to means such as a comparison of the number of copies requested to the number of times the original document has been scanned. So long as more copies are needed, latent images are formed on the photoconductor, and one sheet of paper is fed to the transfer station for each image.

Sheet supply bins 23 and 24 are constructed and arranged to adjustably hold cut sheets of transfer material of different sizes, for example legal and letter size paper, respectively. Sheets therein are oriented such that their narrow dimension is in the direction of paper feed 28. In addition, the sheets in each bin are stacked such that their rear narrow edge (which is parallel to the direction of paper feed 28) lies in a common vertical plane. Thus, if bin 23 contains legal size paper, its front narrow edge overlaps the front narrow edge of letter size paper in bin 24 by some three inches. As a sheet travels down sheet path 28 its long leading edge is presented to gate 39 and transfer station 17 such that this edge is substantially parallel to the axis of photoconductor drum 12.

Figure 2:
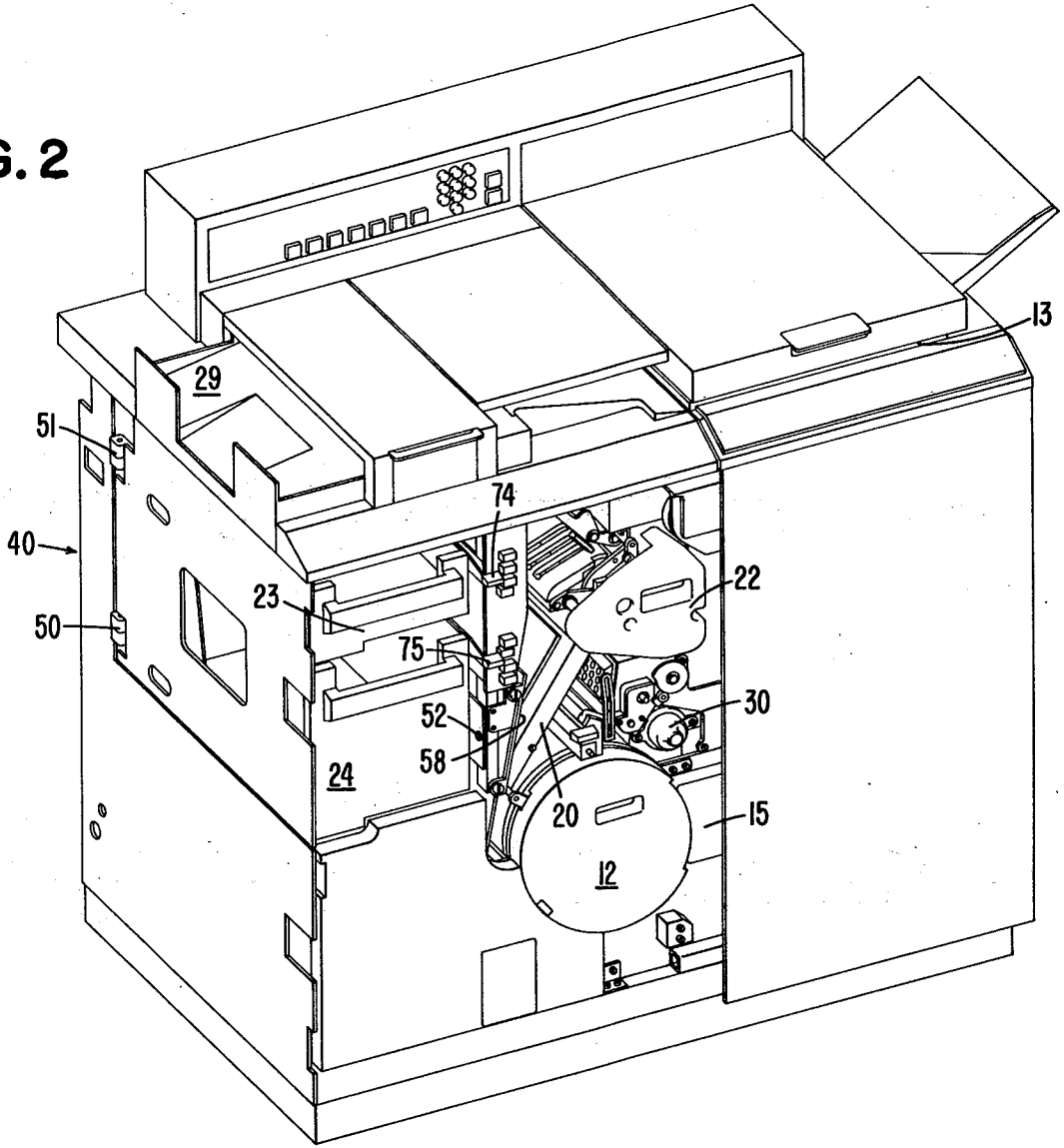
FIG. 2 is a more detailed perspective view of the copier of FIG. 1, with the paper feed module shown in its copier-operative position.
Figure 3:
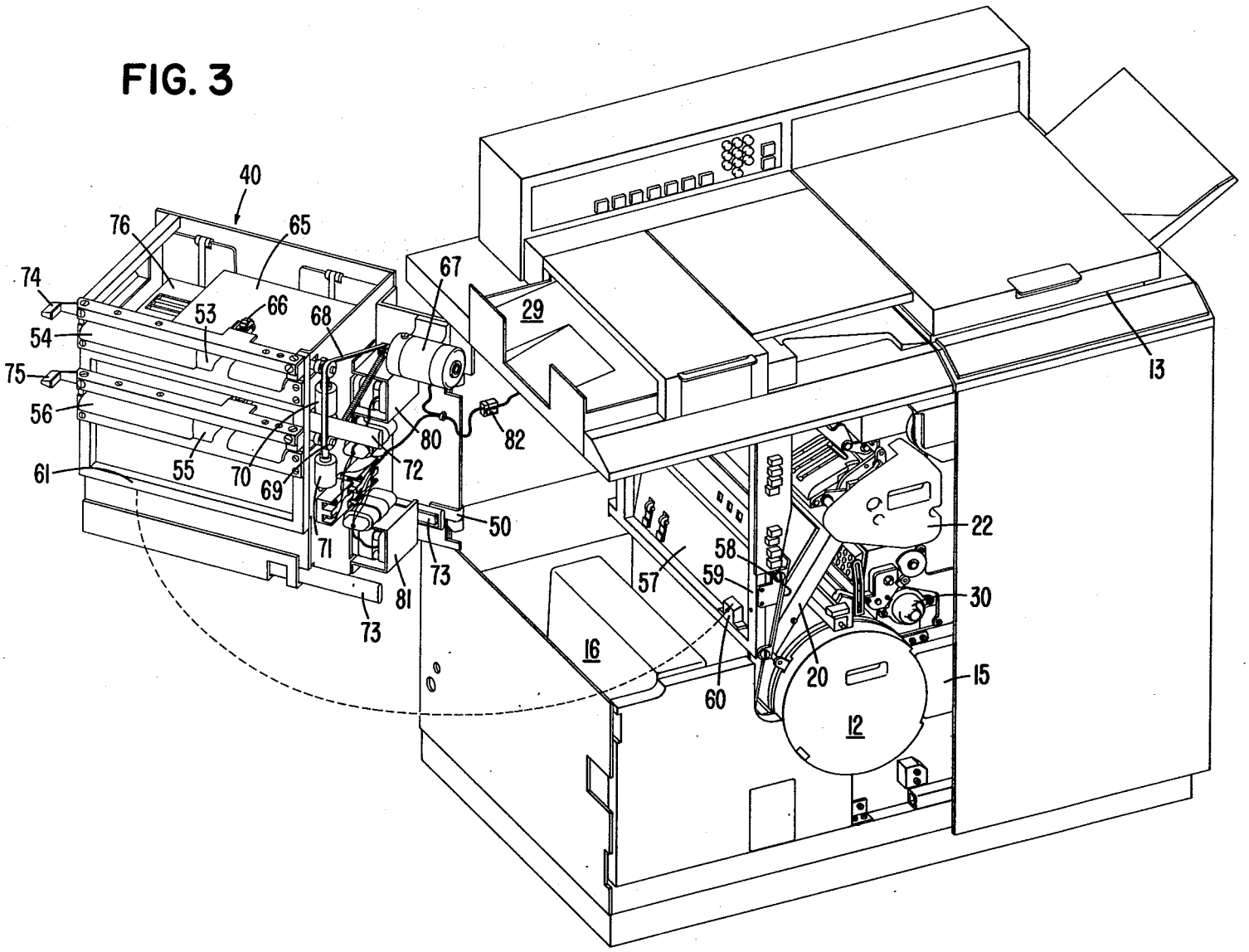
FIG. 3 is a view similar to FIG. 2, showing the paper feed module in its copier-inoperative position.

The present invention is concerned with the paper feed module generally identified within dotted line 40, which module is selectively supported in a copier-operative position, shown in FIGS. 1 and 2, or in a copier-inoperative position, shown in FIG. 3, whereat the module has been pivoted to the left, i.e. clockwise about a rear, left vertical axis as viewed from above.

While the movable mounting means which connects the paper feed module of FIG. 1 to its copier frame is a pivotal mounting means, such as a pair of lift-off hinges, the scope of the present invention is intended to include other mounting means, such as for example telescoping slide rails.

FIG. 2 is a more detailed perspective view of the copier of FIG. 1, showing paper feed module 40, and its two paper supply bins 23 and 24, supported in the copier-operative position. Module 40 is supported by a pair of lift-off hinges 50, 51 at the left rear corner of the module, and is firmly attached to the copier frame by fastener 52, so as to accurately position the module's sheet paths 26 and 27 (FIG. 1) relative to the copier's sheet path aligner 28.

FIG. 3 shows module 40 swung open to its copier inoperative position. This figure more clearly shows the sheet guides 53 and 54 which comprise FIG. 1's sheet path 26, and the sheet guides 55 and 56 which comprise FIG. 1's sheet path 27. FIG. 1's sheet path 28 includes metal plate guide 57 and a spaced, parallel guide 58. FIG. 3 also shows the rigid, stationary copier frame member 59 into which the fastener 52 of FIG. 2 couples. This frame member also includes a positioning lug 60 having an upper surface tilted slightly down to the left, so as to receive the lower crossbar 61 of the paper feed module's frame. When the paper feed module is swung to its copier-operative position of FIG. 2, frame member 61 lies directly on top of positioning lug 60, and is held there by fastener 52, thereby accurately positioning feed paths 26, 27 and 28 relative to each other.

FIG. 3 shows a stack of cut sheets 65 within supply bin 23. A combing wheel 66 cooperates with the top sheet of the stack. This combing wheel is driven by motor 67, by way of timing belt 68, as is a similar combing wheel (not shown) for bin 24, the combing wheel for this bin being attached to pulley 69. The vertical relationship of each bin's combing wheel to the top sheet of the stack is controlled by solenoids 70 and 71, for the bins 23 and 24, respectively.

A more complete description of this specific paper feed means is contained in the above-mentioned copending application, Ser. No. 788,471.

Also shown in FIG. 3 are the reversible elevator motors 80 and 81 for the bins 23 and 24, respectively. The various electrical means, including power connections, necessary for proper operation of paper feed module 70 are connected to the copier logic control system by way of a releasable electrical coupling 82. As shown in FIG. 3, movement of paper feed module from is copier-operative position to its copier-inoperative position does not disturb this connection. Thus, paper feed module 40 remains functionally operative in the position of FIG. 3, such that its operation may be observed, and adjustment or repair thereof can be accomplished.

As is well known by those skilled in the copier art, a copier's logic control system provides one of a variety of means which supply an electrical signal operable to feed a sheet of paper to the copier's transfer station, as needed for each toned photoconductor image passing through the transfer station. Circuit means, normally accessible only to trained service personnel, may also be provided to manually provide this electrical signal, thereby allowing such service personnel to activate the paper feed mechanism, independent of the other copy process devices.

Each of the supply bins 23 and 24 is supported by telescoping rails 72 and 73, respectively, such that, upon actuation of manually operable handles 74 and 75, the stack supporting elevators are lowered, thus allowing the paper supply bins to be withdrawn out of the front of the copier for paper reloading and the like.

The vertically movable stack supporting elevator 76 of bin 23 is shown in FIG. 3. The vertical position of this elevator is controlled by motor 80, as this motor is controlled by a stack height sensing means, as shown in above-mentioned copending application Ser. No. 788,471.

While the invention has been particularly shown and described with reference to a preferred embodiment thereof, it will be understood by those skilled in the art that various changes in form and details may be made therein without departing from the spirit and scope of the invention.

What is claimed is:

1. In a copier having cut-sheet-supply/sheet-feeding means operable to separate a border sheet from a stack and to feed the separated sheet for use in a copy process to make copies therefrom, the improvement comprising:

a frame member supporting the copier's copy process components, including said cut-sheet-supply/-sheet-feeding means, in an operative copy process relationship; and movable mounting means connecting said cut-sheet-supply/sheet-feeding means to said frame such that said feeding means is movable between copier-operative and copier-inoperative positions;

said copier-operative position facilitating sheet feeding into said copier for use in said copy process to produce copies on said sheets; and said copier-inoperative position facilitating copier maintenance by sheet feeding while said feeding means is removed from the remaining copier components.

2. The copier defined in claim 1 including means operable to position and secure said feeding means in said copier-operative position.

3. The copier defined in claim 2 wherein said feeding means includes electrically energizable motive means, and electrical connection means connecting said motive means to said copier in both said copier-operative and copier-inoperative positions.

4. The copier defined in claim 3 wherein said feeding means includes at least one vertically movable sheet stack elevator, and at least one sheet picking means cooperating with the top sheet of said stack, said elevator and sheet picking means being powered by said motive means.

5. In a transfer-type electrophotographic copier having at least one cut sheet supply bin operable to supply copy paper and a sheet path operable to receive and align sheets supplied from said bin prior to being supplied to said transfer station for use in the copy process; the improvement comprising:

a movable frame mounting said supply bin;

paper feeding means for said supply bin mounted on said frame in cooperating relation with paper within said bin;

electrical motive means mounted on said frame and coupled to drive said feeding means; and means movably mounting said frame to said copier in a first copier-operative position whereat said paper feeding means is operable to feed sheets to said sheet path, and a second copier-inoperative position whereat said paper feeding means is operable to feed sheets exterior of said copier during copier maintenance.

6. The copier defined in claim 5 wherein said bin includes a movable paper stack supporting platform, and electrical motive means mounted on said frame and coupled to move said platform.

7. The copier defined in claim 5 wherein said supply bin includes a generally horizontal, movable platform adapted to vertically support a stack of sheets, with the top sheet thereof in operative relation to said paper feeding means, and electrical motive means mounted on said frame to vertically position said platform.

8. The copier defined in claim 7 including a second cut sheet supply bin mounted on said movable frame in vertical alignment with said one sheet supply bin, a second movable paper stack supporting platform for said second supply bin, and second electrical motive means mounted on said frame and coupled to drive said second platform.

9. The copier defined in claim 8 wherein said sheet path includes a sheet aligner upstream of said transfer station.

* * * * *